US005595041A

United States Patent [19]

Hoopengardner

[11] Patent Number: 5,595,041

[45] **Date of Patent: *Jan. 21, 1997**

[54] CARPET INSTALLATION METHOD USING FLEXIBLE CARPET BASE

[75] Inventor: Merle R. Hoopengardner, Lafayette, Calif.

[73] Assignee: Step Loc Corporation, Lafayette, Calif.

[ * ] Notice: The term of this patent shall not extend beyond the expiration date of Pat. No. 5,184,445.

[21] Appl. No.: 527,155

[22] Filed: Sep. 12, 1995

Related U.S. Application Data

[62] Division of Ser. No. 223,827, Apr. 6, 1994, Pat. No. 5,450,698, which is a continuation of Ser. No. 627, Jan. 5, 1993, abandoned, which is a division of Ser. No. 628,443, Dec. 17, 1990, Pat. No. 5,184,445.

[51] Int. Cl.[6] ..... E04F 13/00; E04F 19/04

[52] U.S. Cl. ..... 52/746.1; 52/287.1; 156/71

[58] Field of Search ..... 52/287.1, 288.1, 52/177, 716.1, 716.2, 718.01, 717.03, 717.05, 746.1, 749.1, 741.1; 156/71; 81/488; 7/103

[56] References Cited

U.S. PATENT DOCUMENTS

| | | | |
|---|---|---|---|
| 1,011,642 | 12/1911 | Patterson | 52/287.1 |
| 1,559,747 | 11/1925 | Hall | 52/372 |
| 1,622,656 | 3/1927 | MacDonald | 52/288 |
| 1,722,660 | 7/1929 | Connelly | 52/288.1 |
| 2,211,574 | 8/1940 | McNicholas | 52/717.03 |
| 2,300,084 | 10/1942 | Wright | 52/287.1 |
| 2,441,391 | 5/1948 | Bragiel et al. | 52/288 |
| 2,845,666 | 8/1958 | Knapp | 52/287.1 |
| 3,422,584 | 1/1969 | Howard | 52/288 |
| 3,638,374 | 2/1972 | Harby | 52/287.1 |
| 4,750,226 | 6/1988 | Costill | 7/103 |
| 4,760,681 | 8/1988 | Harrison | 52/288 |
| 4,949,520 | 8/1990 | Bear | 52/288 |
| 5,010,703 | 4/1991 | Pearlman et al. | 52/287.1 |
| 5,212,923 | 5/1993 | Pelosi et al. | 52/287.1 |

FOREIGN PATENT DOCUMENTS

| | | | |
|---|---|---|---|
| 236095 | 10/1964 | Australia | 52/287.1 |
| 1094756 | 12/1954 | France | 52/287.1 |
| 1279333 | 11/1961 | France | 52/287 |
| 98385 | 6/1961 | Norway | 52/288 |
| 959195 | 5/1964 | United Kingdom | 52/288.1 |

*Primary Examiner*—Michael Safavi
*Attorney, Agent, or Firm*—Thomas M. Freiburger

[57] ABSTRACT

A wall base for wall-to-wall carpeting, formed of a rubbery plastic material, has a flat planar portion for engaging against the wall and an outwardly extending bead or flange positioned to engage the surface of the carpet and to cover its edge. In a preferred embodiment the extending bead has a convexly curved upper surface and a flat lower surface, giving the bead appreciable rigidity, so that a carpet with its edge lying over the bead can easily be tucked under the bead using a blade-type tool. In one embodiment the flat lower surface can be downwardly inclined slightly, e.g. about 5°, so that the outer edge line of the bead engages the carpet pile in a sharp line. A tail extension of the flat planar portion extends below the bead or flange and establishes a proper height of the flange above the floor. The carpet wall base of the invention may be installed before installation of a carpet, and may be left in place when a carpet is removed and replaced.

5 Claims, 3 Drawing Sheets

CARPET INSTALLATION METHOD USING FLEXIBLE CARPET BASE

REFERENCE TO RELATED APPLICATION

This is a division of application Ser. No. 08/223,827, filed Apr. 6, 1994, now U.S. Pat. No. 5,450,198, which was a continuation of application Ser. No. 08/000,627, filed Jan. 5, 1993, now abandoned, which was a division of application Ser. No. 07/628,443, filed Dec. 17, 1990, now U.S. Pat. No. 5,184,445.

BACKGROUND OF THE INVENTION

The invention relates to carpet installation and to a carpet base, and more particularly to a vinyl carpet base which can be installed prior to laying the carpet and which can be left in place and reused when the carpet is changed.

Carpet bases have previously comprised either a wooden board (on top of the carpet or adjacent to the carpet edge) or, with commercial installations in particular, a flexible plastic base. One type of flexible plastic base has been a straight planar member, adhered to the wall and extending up from the floor, and against which the edge of the carpet abuts. Another typical flexible member has a flat vertical portion and a flexible concave flange extending outward from the bottom of the base in a generally horizontal direction. The plastic bases are usually of a rubber or vinyl material. After installation of the carpet, the concave or cove type base is installed in such a manner that the bottom of the flange or cove section presses down on top of the carpet causing the flange to flex outwardly somewhat while applying downward pressure on the carpet.

One problem with the described system is that, due to the design and shape of the cove type base it is generally not possible to install such a base before laying the carpet, or to leave a base in place when carpet is taken up and replaced. The flexible nature of the cove flange, and its desired position for bearing against the carpet surface render it difficult to insert the carpet underneath the cove. Also, with such a vinyl base already in place, trimming the carpet would be difficult.

SUMMARY OF THE INVENTION

In accordance with the present invention, an improved carpet base and a method of use of the base enable the base to be installed prior to laying of the carpet and to remain when carpeting is replaced, avoiding the problems of the prior art.

The configuration of the carpet base of the invention makes it easy to trim a carpet and then tuck the carpet edge under the base with the base already mounted on the wall. The carpet base can be reused when new carpet is installed without having to remove or reinstall the carpet base.

With the carpet base of the present invention, carpeting is efficiently and cleanly installed, and can be later removed and replaced in an efficient manner, without removal of the wall-attached base.

A carpet base of the present invention comprises a vertical base member and an integral rigid flange or bead member protruding from the vertical base member in a generally horizontal direction. The flange member may be generally constructed in a quarter-round shape with a flat bottom surface which extends outwardly from the vertical base member in a horizontal (or somewhat downwardly inclined) direction thereby forming a right or slightly acute angle to the base. The convexly rounded top surface of the flange gives thickness and rigidity to the flange. The carpet base preferably is formed of a vinyl or other rubbery material (similar to prior conventional vinyl bases), which may be the product Vynite (a mix of rubber and vinyl) sold by Mercer Vinyl, or material as in a base marketed by Roppe Rubber. It is important that the flange bead have adequate stiffness and rigidity to enable trimming against it and to allow easy tucking of the carpet edge under the flange, in a sliding tucking motion.

The flat bottom surface of the flange member intersects the vertical base member at a point above the bottom edge of the vertical base member corresponding generally to the thickness of a carpet, with a stem extension below the flange for extending down to the floor. Horizontal score lines may be provided on the stem extension below the flat bottom surface of the flange. This enables the base to be used to fit a thinner carpet by tearing or trimming material from the stem extension along one of the score lines.

By the method of the invention, the carpet base is first attached to one or more walls using adhesive or other similar means. The adhesive can be pre-attached, for example double-stick tape or other pressure sensitive adhesive applied to the back of the base, with a release strip to be removed, or normal base adhesive, as conventionally used, can be applied on the job. Before installation the base's stem extension should be trimmed as necessary to suit the particular thickness of the carpet to be installed.

After attaching the base to the walls along which the carpet is to be installed, the carpet and, if carpet pad is used, a carpet pad are then laid out and trimmed to size. If a pad is used, it is cut to a line somewhat out from the bead or flange, and this distance can depend on the thickness of the carpet. The carpet is rough cut to overlap the bead or flange at the walls, lying over the flange and usually extending farther up the base in the rough cut. It can then be trimmed by using a carpet trimmer run along the outside of the base bead as a guide, with the blade set to cut about ¼ inch beyond the guide, so as to leave a margin for tucking under the bead or flange.

When trimming of the carpet has been completed, the edge of the trimmed carpet is then tucked underneath the flange member by running a carpet tucking tool along the carpet/flange line to draw the carpet edge under.

In cases where the carpet base of the invention is present with a carpet which is to be replaced by new carpet, the old carpet is removed, pulling it out from under the base bead and the new carpet is installed as described above.

It is therefore among the objects of the invention to provide an improved flexible carpet base and a more efficient method for installing wall-to-wall carpeting using the base. These and other objects, advantages and features of the invention will be apparent from the following description of preferred embodiments, considered along with the accompanying drawings.

DESCRIPTION OF PREFERRED EMBODIMENTS

Figure 1:
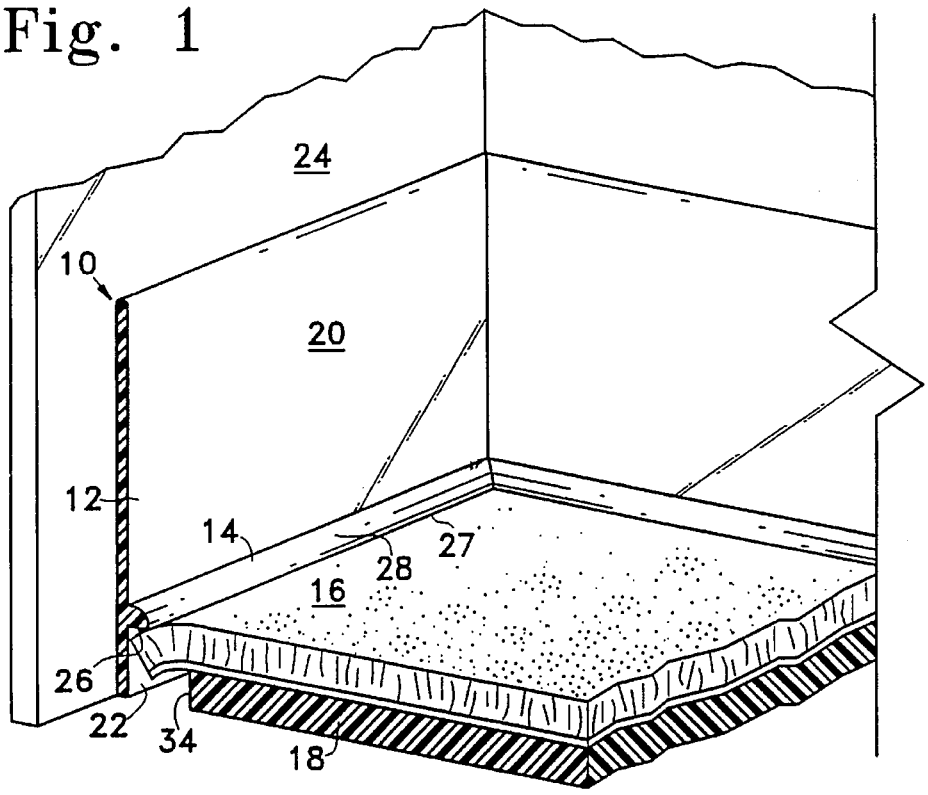
FIG. 1 is a perspective view partially in section, showing a carpet base or wall base according to the present invention with a carpet and pad installed in place.

In the drawings, FIG. 1 shows a carpet base 10 comprising a vertical base member 12 and a rigid flange 14 or cove or bead for use in bearing against and providing a finished appearance at the edge of a carpet 16. A carpet pad 18 may or may not be included in the installation.

Figure 3:
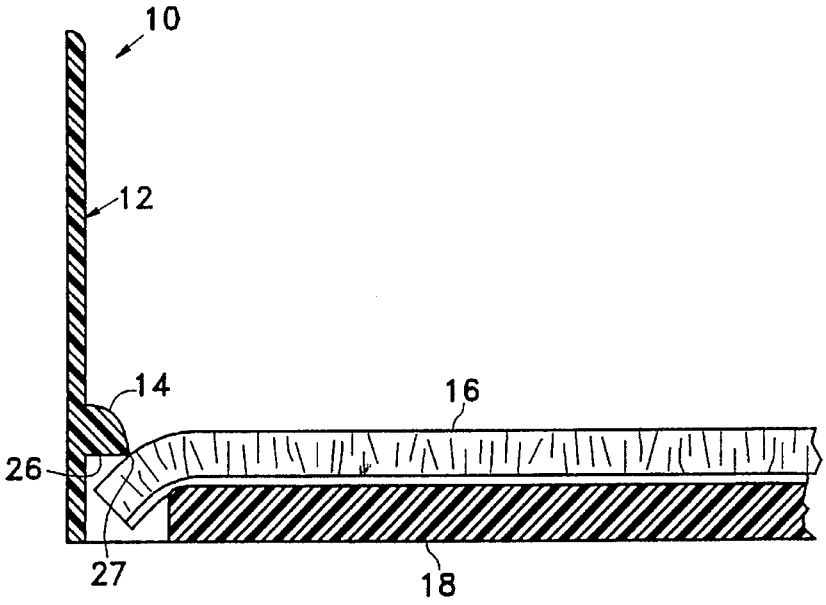
FIG. 3 is a transverse cross-sectional elevation view of the carpet base according to the present invention.

The vertical base member 12, as shown in FIGS. 1 and 3, can be considered as comprising an upper or top section 20 and a lower extending tail section 22, below the rigid flange or bead 14. The base 10 is formed of one integral extrusion. The vertical base member 12 is generally planar in shape so as to engage flatly against the surface of a wall 24.

The planar vertical base member 12 of the preferred embodiment has a thickness of approximately ⅛ inch and a total height which may be between about three and five inches, preferably about four inches. The tail section 22 will usually be of a height from ¼ to 1 inch, although excess material will generally be provided in order to permit trimming of the tail section to accommodate the height of the carpet 16, which may have an underlying pad 18.

The flange or bead 14 in one embodiment is constructed to be generally sloping at its upper surface 28, and tapering from a maximum thickness at the planar vertical member 12 to zero thickness at an outer extremity or edge 27. In a preferred embodiment the flange 14 is generally quarter-round in shape and has a flat bottom surface 26 and a rounded top surface 28. The flat bottom surface 26 projects outwardly from the vertical base member 12 generally horizontally and generally at right angles to the vertical base member, although in one preferred embodiment it may extend slightly downwardly at about a 5° angle.

In a preferred embodiment, the flange or bead 14 extends outwardly from the flat vertical portion 12 by a distance of about ½ inch and the thickness (height) of the bead at the planar member 12 may similarly be about ½ inch. The preferably rounded top surface 28 of the flange or bead 14 may be generally symmetrical in the sense that its cross section may form an arc. This convex shape (whether arcuate, elliptical or otherwise) adds rigidity to the bead or flange, to a greater extent than would be the case if the bead surface 28 were planar or concave. This substantial rigidity is important in resisting any significant deflection or deformation when the carpet is being tucked underneath the bead or flange. Some flexibility is inherent in a rubbery vinyl material, but the cross section of the bead or flange should be such as to resist deformation (beyond perhaps a few millimeters) when a tucking tool is used with moderate force, to tuck a carpet edge under the bead. Since conventional vinyl cove base members have tended to be thin and highly flexible, these have not provided a substantially rigid surface against which a tool can be used to tuck the carpet edge under. Further, as discussed above, their flimsiness tends to make it difficult or virtually impossible to replace carpeting with a new carpet using the same base.

However, it should be understood that the principles of the invention require only that the bead be substantially rigid and pleasing in appearance. Other cross sections can be employed, so long as the bead 14 tapers in thickness to a well-defined edge 27, with sufficient strength and rigidity to firmly engage the carpet and to enable a bladed tool to be used for tucking the carpet edge under as in FIG. 2.

Figure 2:
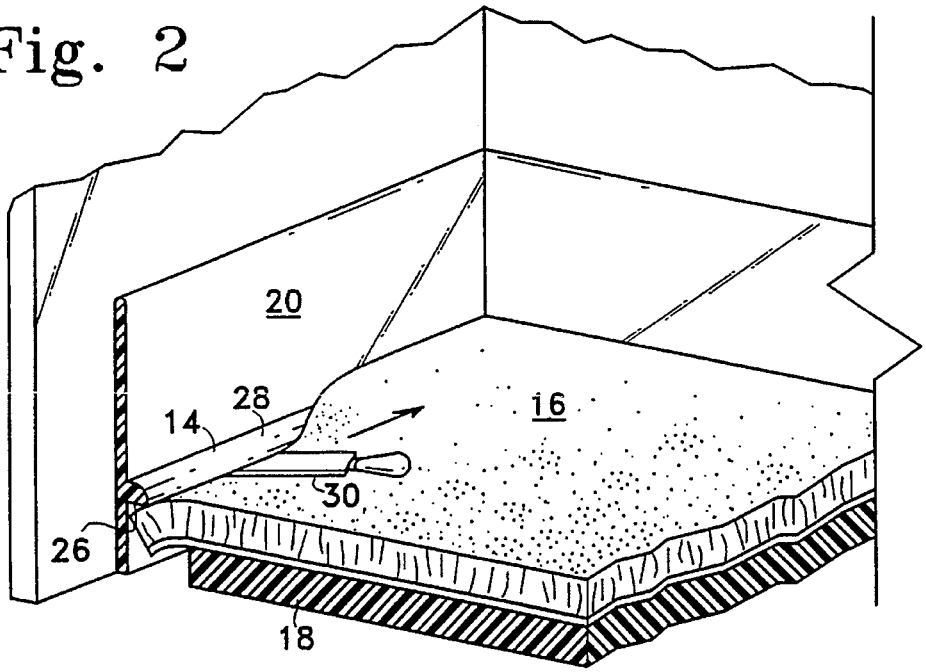
FIG. 2 is a perspective view showing the edge of a carpet being tucked underneath the carpet base.

FIG. 2 shows the operation of tucking a trimmed carpet 16 under the base flange or bead 14, using a tucking tool 30 which is drawn along as indicated, pulling and pushing the carpet edge down around the rounded base surface 28 and under the planar bottom surface 26 of the bead. The convex roundness of the flange or bead surface 28 tends to assist the edge of the carpet in being drawn down under the bead.

Figure 6:
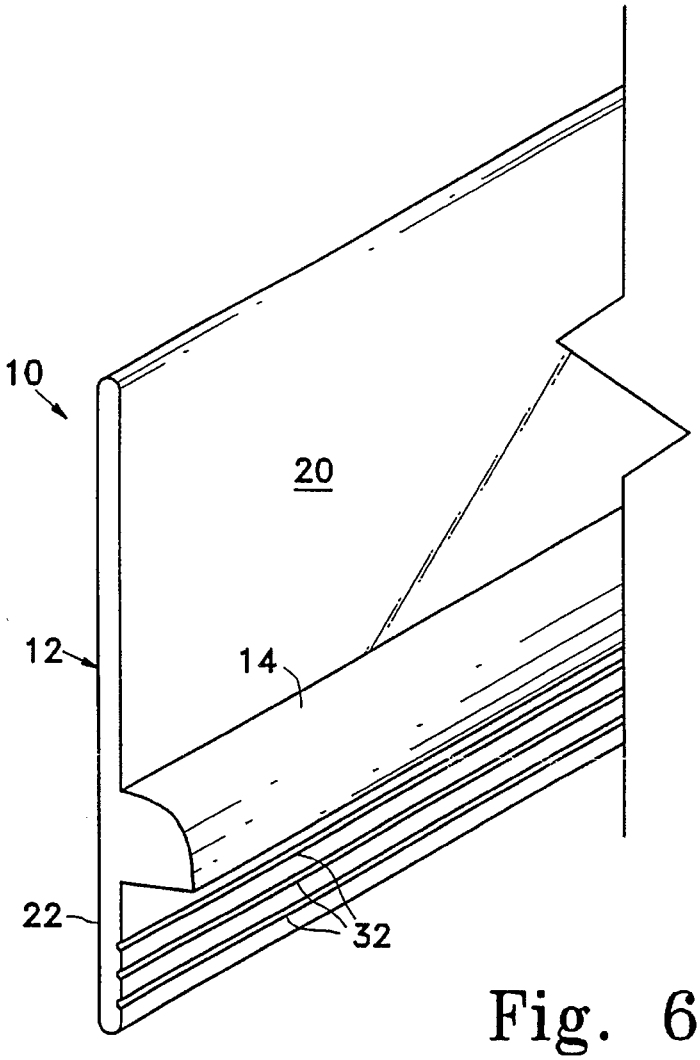
FIG. 6 is a perspective view showing a wall base according to the invention, with provision for height adjustment at its lower end.

As shown in FIG. 6, a plurality of horizontal and parallel score lines 32 may be formed through the length of the carpet base 10, in the lower extension or tail section 22. This enables excess material to be removed from the section 22, adjusting the height of this section to assure that the distance between the bead 14 and the lower edge of the tail section is appropriate for the thickness of the particular carpet 16. Such score lines, for removal of excess material to achieve an appropriate dimension, have in themselves been known. The selected vertical distance preferably is about the same as the height of the carpet itself, provided the carpet cushion 18 is positioned with its edge 34 sufficiently back from the wall and from the base bead 14. In one embodiment, installation may be made with the edge 34 of the cushion anywhere from about flush with the protruding edge 27 of the flange or bead 14 to a position about ¾ inch out from the flange 14. More preferably, the outward spacing of the cushion from the outer terminus 27 of the flange 14 is in the range of about ⅛ inch to ¾ inch.

FIGS. 1 and 3 show that the carpet 16, after having been tucked under the bead 14 of the base 10, may angle downwardly somewhat as it extends over the cushion 18, partially compressing it at its edge, and then under the bead 14. As mentioned above, the lower surface 26 of the bead 14 may be inclined downwardly slightly, for example about 5°, thus forming a somewhat downward oriented edge 27 which tends to grip against the carpet pile.

If desired, both the carpet 16 and the cushion 18 can be coterminous, both extending part way under the base bead or flange 14. However, the arrangement shown, with the cushion spaced away from the flange 14, is preferred. There is no need for the cushion to extend under the bead and installation is made easier with the cushion spaced outwardly. It would be very difficult to trim and tuck the cushion under the base. By trimming the cushion short of the base different thickness carpets can be installed with the same base.

The system of the present invention is useful with glue-down installations, whether a cushion 18 is used or not. In particular, it is useful with the applicant's Step Loc system disclosed in U.S. Pat. Nos. 4,557,774 and 4,797,170.

Figure 4:
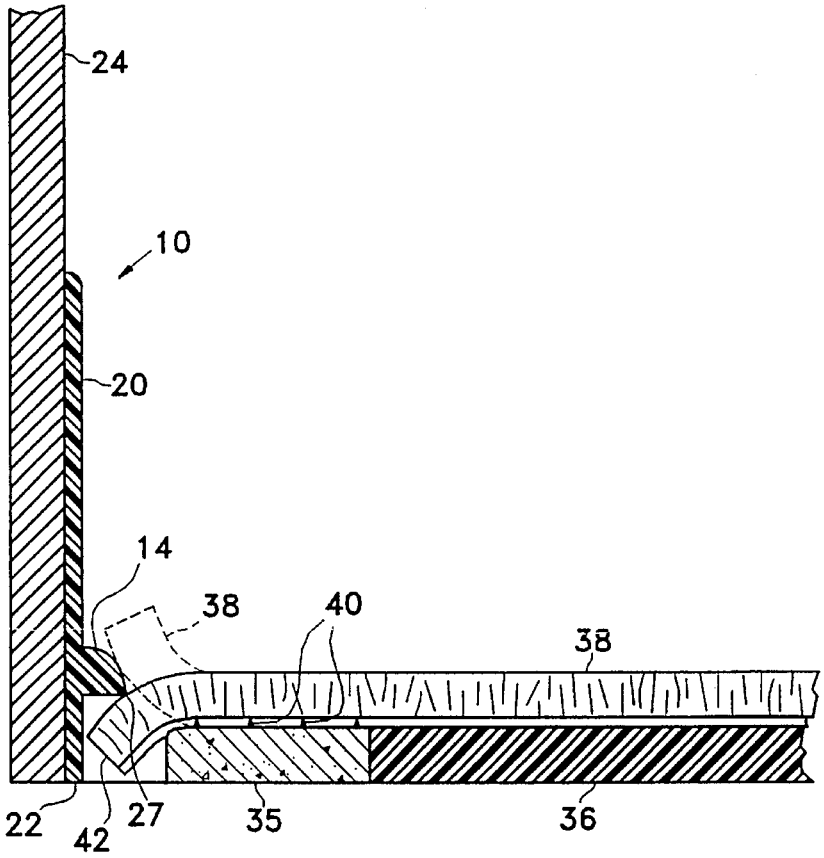
FIG. 4 is an elevational section view similar to FIG. 3 wherein the carpet is installed using a conventional tackless strip system.

The carpet wall base of the invention is also advantageously used with tackless strip, stretched wall-to-wall carpeting, as illustrated in the sectional view of FIG. 4. As shown in that figure, a tackless strip 35, a product well known in the carpet installation industry, is secured to the floor at a position spaced slightly outwardly from the extremity or outer edge 27 of the bead or flange 14. In a preferred embodiment, this distance is about ¼ to ½ inch. A carpet cushion 36 is positioned to extend up to the other side of the tackless strip 35, in the usual manner. A carpet 38 is stretched and secured to gripping tacks 40 of the tackless strip, and the carpet edge 42 is trimmed such that it initially lies on top of the upper surface of the wall base bead or flange 14, as shown in dashed lines in FIG. 4. The carpet edge is then drawn under the bead or flange 14 in the manner described above with reference to FIG. 2.

As discussed above, the floor-engaging tail extension 22 of the carpet base 10 may be provided at the appropriate height for the tackless strip carpet installation, or material may be removed as described above to attain this proper height. The proper height of the flange 14 above the floor will vary with the thickness of the carpet 38. Generally, the extremity 27 of the bead or flange 14 can be about the same height as the height of the tackless strip 35, and normally not lower than the tackless strip. With the tackless strip 35 spaced away from flange by about ¼ to ½ inch, this will give the ability to tuck most carpets (except unusually thick carpets) under the flange 14.

Figure 5:
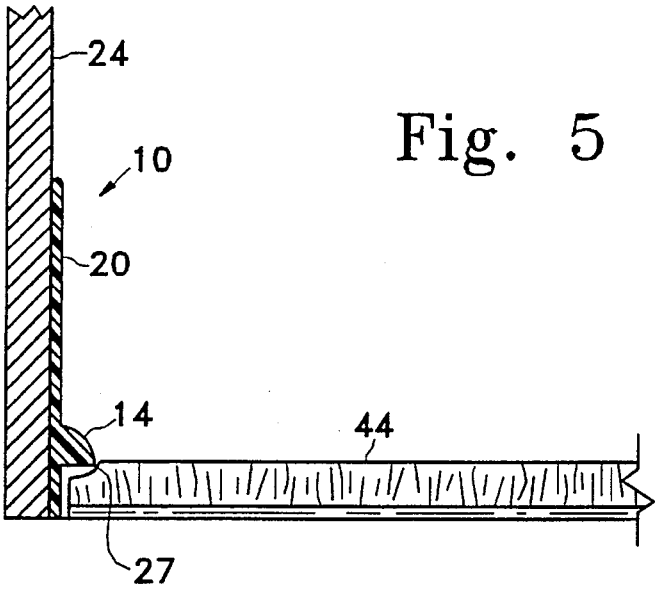
FIG. 5 is another sectional view similar to FIG. 4, but showing a carpet installation without a carpet pad, adhered to the floor as by glue down installation.

FIG. 5 shows an installation wherein a carpet 44 is installed by direct adhesion to the floor, without any cushion and without stretching. In this installation, the height of the flange 14 above the floor is somewhat less. This height preferably is set to compress the carpet pile slightly, as shown. For example, the height of the bottom of the flange 14 might be the same as or less than the total height of the uncompressed carpet.

As FIG. 5 illustrates, the final trimming of the carpet is made such that the carpet will extend at least part way under the bead or flange 14. It is not important that the carpet edge reach the wall, but only that the protruding edge 27 of the base flange cover the carpet and provide a finished appearance. As explained above, a special offset cutting tool can be used to bear against the bead or flange 14 as a guide in making a cut which is ¼ inch to ½ inch longer than the location of the bead edge 27.

On the other hand, the carpet edge can be cut slightly beyond an appropriate length to reach the wall. Especially in an installation with a cushion 18, such as shown in FIG. 3, the carpet edge may be turned downwardly in passing under the flange 14 to the extent that a slight overcut is accommodated.

The above described preferred embodiment is intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A method for installing a wall-to-wall carpet on a floor, such that the edge of the carpet is engaged by and covered by a pre-installed carpet wall base secured to the wall, comprising, adhering to the wall at the floor a carpet wall base, said carpet wall base comprising an integral extrusion of a generally rubbery plastic material and having a generally vertical flat back surface lying flatly against and adhering to the wall, and the wall base having a shape defining a generally flat tail extension at its lower end with a bottom edge of the tail extension substantially engaged against the floor and the shape further defining a protruding edge extending outwardly, away from the wall, with a generally flat bottom surface just above the tail extension, said generally flat bottom surface projecting outwardly and substantially rigid in a direction away from the wall and terminating at said protruding edge, so that upon adhering the carpet wall base to the wall the generally flat bottom surface and protruding edge are spaced above the floor and form a substantially rigid extension of the carpet wall base, after a carpet has been installed on the floor, trimming the carpet such that the edge of the carpet extends up onto the carpet wall base over the protruding edge, and tucking the carpet edge under the protruding edge using a blade type tool engaged between the top surface of the carpet and the protruding edge, and sliding the tool longitudinally with the tool engaged against the substantially rigid protruding edge, to thereby progressively draw the carpet edge down under the protruding edge and under the generally flat bottom surface along the length of a wall, whereby the carpet is engaged by the carpet wall base and the carpet's edge is covered.

2. The method of claim 1, wherein the carpet is adhered to the floor, except under and adjacent to the protruding edge of the wall base.

3. The method of claim 1, wherein the carpet is installed with a carpet cushion beneath, and wherein the carpet cushion is adhered to the floor and the underside of the carpet is adhered to the top surface of the carpet cushion, with the carpet cushion being spaced outwardly from the protruding edge, and the tail extension of the wall base being of an appropriate height to accommodate the carpet with the carpeting extending over the edge of the cushion and downwardly under the protruding edge.

4. The method of claim 1, wherein the carpet is secured to the floor by stretching, with tackless strips positioned adjacent to but spaced outwardly from the wall base, and with the carpet extending beyond the tackless strip and being tucked under the protruding edge and generally flat bottom surface.

5. The method of claim 4, wherein the tackless strip is spaced outwardly about ¼ to ½ inch from the protruding edge of the wall base.

* * * * *